US006044910A

United States Patent [19]

Aebischer et al.

[11] Patent Number: 6,044,910

[45] Date of Patent: Apr. 4, 2000

[54] MIXING DEVICE FOR FLUIDS

[75] Inventors: Frëderic Aebischer, Luterbach, Switzerland; Manfred Russwurm, Bad Schwartau, Germany

[73] Assignee: Asea Brown Boveri AG, Baden, Switzerland

[21] Appl. No.: 09/156,756

[22] Filed: Sep. 17, 1998

[30] Foreign Application Priority Data

Sep. 30, 1997 [EP] European Pat. Off. ..... 97 810 179

[51] Int. Cl.[7] ..... A62C 2/00; B05B 7/04

[52] U.S. Cl. ..... 169/14; 169/15; 169/43; 169/44; 239/432; 239/433; 239/434; 137/897

[58] Field of Search ..... 169/43, 14, 15, 169/44; 239/432, 433, 434; 137/896, 897

[56] References Cited

U.S. PATENT DOCUMENTS

| | | | |
|---|---|---|---|
| 1,542,294 | 6/1925 | Fogler | 239/433 X |
| 2,075,867 | 4/1937 | Sampel | 239/432 X |
| 3,332,442 | 7/1967 | Reed | 239/433 X |
| 4,483,482 | 11/1984 | Junger et al. | 239/434 |
| 5,495,893 | 3/1996 | Roberts et al. | 137/896 X |

FOREIGN PATENT DOCUMENTS

| | | |
|---|---|---|
| 2608438 | 6/1988 | France . |
| 295 10 982 U | 11/1995 | Germany . |
| WO94/08659 | 4/1994 | WIPO . |
| WO9524274 | 9/1995 | WIPO . |
| WO95/28204 | 10/1995 | WIPO . |
| WO95/28205 | 10/1995 | WIPO . |

*Primary Examiner*—Lesley D. Morris
*Assistant Examiner*—Robin O. Evans
*Attorney, Agent, or Firm*—Burns, Doane, Swecker & Mathis, L.L.P.

[57] ABSTRACT

A device for introducing $CO_2$ into a preferably liquid extinguishing medium includes a housing (1) with a feed line (2) for extinguishing fluid, a feed pipe (4), provided with a metering valve (3), for $CO_2$, as well as an outlet line (5). The housing (1) is aligned with its longitudinal axis vertical; the feed line (2) for extinguishing fluid is connected to the housing at the lower end thereof; the outlet line (5) branches off from the upper end of the housing. The $CO_2$ feed pipe (4) opens into the housing from above, extends as far as the lower end thereof and is provided at the pipe end with injection fluid (6). The $CO_2$ is directed in the feed pipe in the opposite flow direction to the extinguishing fluid; the length of the feed pipe between the metering valve (3) and injection fluid (6) is dimensioned such that during operation with the metering valve (3) closed a gas cushion (7) forms on its downstream side.

7 Claims, 1 Drawing Sheet

FIG. 1
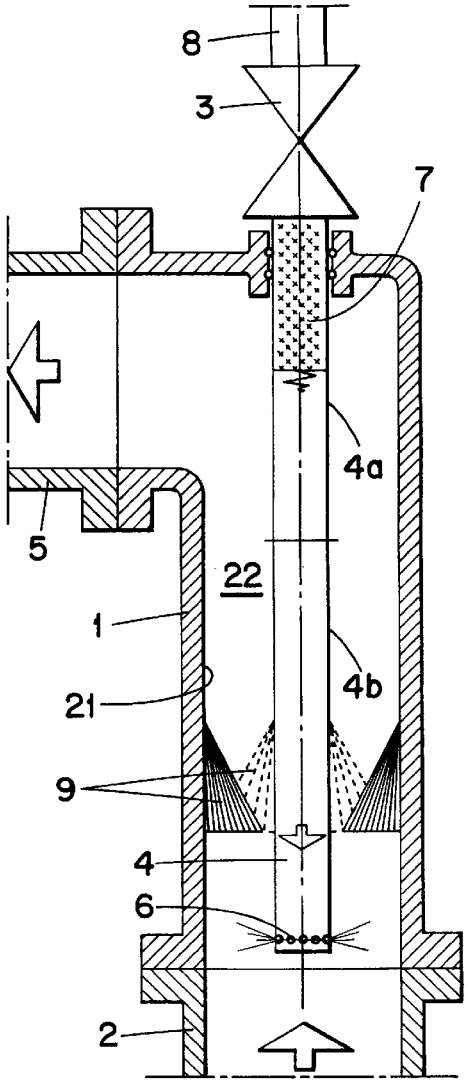
FIG. 2
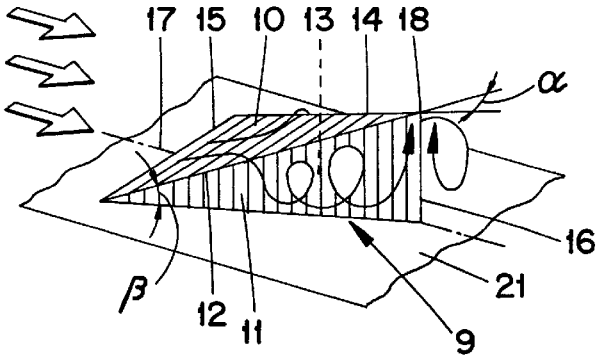
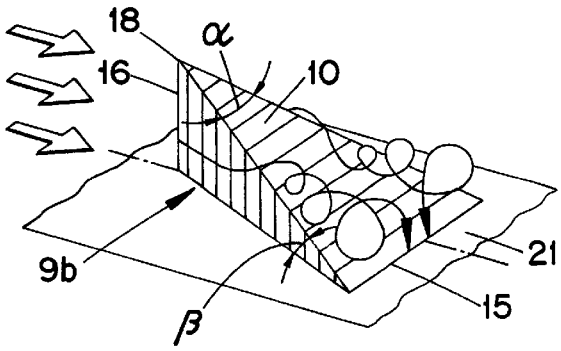
FIG. 3

MIXING DEVICE FOR FLUIDS

BACKGROUND OF THE INVENTION

1. Field of the Invention

The invention relates to a device for introducing $CO_2$ into a preferably liquid extinguishing medium, including a housing with a feed line for extinguishing means, a feed pipe, provided with a metering valve, for $CO_2$, as well as an outlet line. Homogeneous bubble flows can be generated upstream of the extinguishing nozzle of fire extinguishing systems with the aid of such devices.

2. Discussion of Background

Although not for $CO_2$, such mixing devices are adequately known, for example from WO 95/24272. In this case, the inert gas is generally added in gaseous form and also serves as propellant for the extinguishing means. The inert gas is fed intermittently into the mixing device, in order to achieve a defined plug flow in the feed line to the extinguishing nozzles. A further known solution for hand-held fire extinguishers in accordance with DE-U1 295 10 982 provides that $CO_2$ is added to the extinguishing means at the extinguishing nozzle itself. The aim thereby is to generate an aerosol-like mixture with water droplets brought to freezing temperature. It goes without saying that it is not possible with the aid of this measure to produce a homogeneous bubble flow upstream of the extinguishing nozzle.

SUMMARY OF THE INVENTION

Accordingly, one object of this invention is to provide a novel mixing device of the aforementioned type in which a largely homogeneous two-phase mixture is generated with defined $CO_2$ bubbles which prevail up to the down-stream extinguishing nozzle. A further object resides in providing a measure which substantially avoids icing of the extinguishing means when the liquid $CO_2$ expands.

According to the invention, this is achieved by virtue of the fact that the housing is aligned with its longitudinal axis vertical; that the feed line for extinguishing means is connected to the housing at the lower end thereof, that the outlet line branches off from the upper end of the housing, that the $CO_2$ feed pipe opens into the housing from above, extends at least approximately up to the lower end thereof, and is provided at the pipe end with injection means; it being the case that the $CO_2$ in the feed pipe is directed in the opposite flow direction to the extinguishing means, and that the length of the feed pipe between the metering valve and injection means is dimensioned such that during operation with the metering valve closed a gas cushion forms on its downstream side.

The advantages of the invention are to be seen, inter alia, in the particular simplicity of the measure. Again, the device is very effective at an operating pressure of less than 12 bar. This means that the entire extinguishing system with the lines and valves and fittings located therein can be designed for the 16 bar which are proper for protection against fire.

It is particularly expedient when three-dimensional vortex-generating means are provided on the outer wall of the feed pipe and/or on the inner wall of the housing. It is possible thereby to generate large-scale longitudinal vortices which permit rapid, controlled mixing of the flowing substances in conjunction with a low pressure loss within a very short distance. The advantage of such a vortex generator is to be seen in its particular simplicity in every regard. Furthermore, owing to its generally hollow interior the element can be used to inject the inert gas into the channel through which the extinguishing means is flowing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein, FIG. 1 shows a longitudinal section through a mixing device;

FIG. 2 shows a perspective representation of a vortex generator; and

FIG. 3 shows a variant arrangement of the vortex generator.

Only the elements essential for understanding the invention are shown. Not shown are the preparation, undertaken upstream of the mixing device, of the inert gas and of the extinguishing means, nor the extinguishing nozzles arranged downstream of the mixing device.

DESCRIPTION OF THE PREFERRED EMBODIMENTS

Referring now to the drawings, wherein like reference numerals designate identical or corresponding parts throughout the several views, in accordance with FIG. 1 the device comprises a housing 1 which is arranged with its longitudinal axis vertical and, in the simplest case, can be a cylindrical, metallic pipe. At its lower end, it is connected to a feed line 2 for extinguishing means via a commercially available fastening (not represented). At its upper end, the housing is penetrated by a feed pipe 4, provided with a metering valve 3, for $CO_2$, the metering valve being located directly outside the housing. A $CO_2$ connection 8 is provided upstream of this metering valve. An outlet line 5 leading to the extinguishing nozzles branches off from the housing, likewise from the upper end.

The $CO_2$ feed pipe 4 extends in the case of the example in a fashion running coaxially up to the lower housing end. It is provided at the pipe end with injection means 6 which, in the simplest case, are bores arranged regularly over the circumference of the pipe. It goes without saying that the pipe end should be closed in this case. The feed pipe is designed in two parts, the part 4*a* adjacent to the metering valve consisting of a material of poor thermal conductivity, and the part 4*b* adjacent to the injection means consisting of a material of good thermal conductivity. This is based on the following considerations, which are explained with reference to the mode of operation:

The following data provide the basis: use is made as extinguishing means of water at a pressure of between 4 and 10 bar, preferably 6 bar, and at a temperature of preferably 10° C. A water speed of approximately 5 m/sec inside the housing 1 is considered to be favorable. $CO_2$ is used as inert gas, it also being possible of course, to conceive of other water-soluble means. The liquid $CO_2$ is fed into the connection 8 via a high-pressure line (not represented) at a pressure of at most 70 bar and a temperature of approximately 30° C. The metering valve serves the purpose of the actual flow control. At the same time, it executes the function of a non-return valve when starting up or running down the system, or when it is being used, possibly, for intermittent operation.

With the metering valve 3 closed, the extinguishing means penetrates from the housing 1 via the injection means 6 into the interior of the feed pipe 4 and rises up therein. In so doing, it compresses the gas column present therein—which consists of air, at least during starting up—and displaces it against the metering valve 3 by forming a gas cushion 7. The representation in FIG. 1 corresponds to this state. The gas cushion prevents water from coming into contact with the metering valve. It may be seen from this that the feed pipe 4 may not undershoot a certain length in order to generate a suitable gas plug. In order to avoid icing, the gas cushion 7 must be dimensioned such that no water reaches the valve even in the case of the most pronounced formation of vortices in the water column. Specifically, it is during the opening of the metering valve subsequent to this that this formation of vortices and the risk of icing caused thereby exits. The liquid $CO_2$ is expanded in the valve to approximately 8 bar and can reach a temperature of −45° C. in the process. It goes without saying that a possible contact with water would immediately change this water to ice and would seal the feed pipe. The liquid inert gas penetrates into the feed pipe and displaces the column of extinguishing means back into the housing via the gas cushion. In the process, the $CO_2$ is heated, and vaporization occurs at least partially when its triple point is reached. This is the reason for designing the feed pipe 4 in two parts. The part 4*a* adjacent to the metering valve is preferably finished from poorly conductive plastic, in order to ensure as little heat exchange as possible between the cold liquid inert gas and water, which flow in opposite directions, in the housing. The aim is to avoid in any case the occurrence of further instances of icing, including of a local type, in this region in the housing interior. In order, on the other hand, to promote heating and vaporization of the inert gas further downstream, a material of good thermal conductivity is selected here in part 4*b*.

The injection means, which can be radial bores or a sieve-like attachement, are dimensioned so as to produce a homogeneous fine distribution of the gas in the water with the smallest possible gas bubbles as early as during injection of the inert gas into the channel through which the extinguishing means flows. However, it is to be ensured in this case that the nozzle bores are, in turn, large enough for freezing of the openings to be reliably avoided.

Even if the abovementioned triple point is not reached inside the pipe 4, the liquid inert gas vaporizes in any case upon contact with the warmer water and is thereby dissolved. An attempt is made here initially to dissolve as much gas as possible; the aim is to reach the state of saturation of the mixture.

More $CO_2$ is introduced into the extinguishing means than can be dissolved therein, in order to form a defined bubble flow downstream of the injection. The undissolved, excessive proportion is present in the form of bubbles.

Depending on the respective pressure and temperature, the mixture tends to evaporate; a pressure loss in the line therefore entails evaporation. Part of the pressure drop is compensated by degassing the dissolved inert gas. The effect of the evaporation is a rise in volume. The following values may be given as an example:

When 25 grammes of inert gas are injected at a pressure of 7 bar into one liter of water at 10° C., 15 grammes are dissolved; 10 grammes expand at 7 bar to a volume of 0.8 liters. The total volume is thus 1.8 liters, and the total weight of the mixture is 1025 grammes. Consequently, the mixture has a specific weight of approximately 0.57 kg/liter. By contrast with a pure water flow, this means a substantially lower pressure loss in the line system to the extinguishing nozzles. The new measure at least achieves an advantageous maintenance of pressure in the system, as was determined by experiments. Finally, this means that approximately the same extinguishing pressure is applied to all the extinguishing nozzles independently of the associated line length.

The abovementioned large holes in the injection means 6 could have the effect of rendering it impossible to carry out the homogeneous fine distribution, already desired at the beginning, of the gas in the water. To provide a remedy here, flow-influencing means in the form of vortex generators 9 are arranged on the housing wall 21 or the outer wall of feed tube 4 (illustrated in fantom) in the channel through flow occurs. These vortex generators are arranged so that a sufficiently large mixing zone 22 is available downstream of them inside the housing.

In accordance with FIGS. 2 and 3, such a vortex generator includes three triangular surfaces freely enveloped by flow. These are a roof surface 10 and two lateral surfaces 11 and 13. In their longitudinal extent, these surfaces run at specific angles in the flow direction.

The lateral walls, which consist of right angled triangles, are fixed with their longitudinal sides on the housing wall 21. They are orientated such that they form a joint on their narrow sides and enclose an arrow angle $\alpha$. The joint is designed as a sharp connecting edge 16 and is likewise at right angles to that wall 21 with which the lateral surfaces are flush. When installed in a channel, the through-flow cross section is scarcely impaired by blockage, because of the sharp connecting edge. The two lateral surfaces 11, 13 enclosing the arrow angle $\alpha$ are symmetrical in shape, size and orientation and are arranged on both sides of an axis 17 of symmetry. This axis 17 of symmetry has the same alignment as the channel axis.

With an edge 15 running transverse to the flow-enveloped wall and designed to be very flat, the roof surface 10 bears against the same wall 21 as the lateral walls 11, 13. Their longitudinally directed edges 12, 14 are flush with the longitudinally directed edges, projecting into the flow channel, of the lateral surfaces. The roof surface runs at an angle of incidence $\beta$ to the wall 21. Its longitudinal edges 12, 14 form an apex 18 together with the connecting edge 16.

In FIG. 2, the connecting edge 16 of the two lateral surfaces 11, 13 forms the downstream edge of the vortex generator 9. The edge 15, running transverse to the flow-enveloped wall 21, of the roof surface 10 is therefore the edge to which the channel flow is first applied.

The method of functioning of the vortex generator is as follows: when there is a flow around the edges 12 and 14, it is converted into a pair of oppositely rotating vortices. The vortex axes are situated along the axis of the flow. The geometry of the vortex generators is selected such that no backflow zones are produced when vortices are generated.

The swirl number of the vortex is determined by appropriate selection of the angle of incidence $\beta$ and/or of the arrow angle $\alpha$. With rising angles, the vortex intensity or the swirl number increases, and the site of the vortex breakdown—to the extent this is at all desired—migrates upstream as far as into the region of the vortex generator itself. Depending on the application, these two angles $\alpha$ and $\beta$ are prescribed by design features and by the process itself. It is then necessary to adapt only the height of the vortex generator, which corresponds to that of the connecting edge 16.

Generally, the height h of this connecting edge 16 will be coordinated with the channel height H such that directly downstream of the vortex generator the vortex generated already achieves a size such that the entire channel height or the entire height of the channel part assigned to the vortex generator is filled up, something which leads to a uniform distribution in the cross section affected by the flow. A further criterion which can influence the ratio h/H to be selected is the pressure drop which occurs when the vortex generator is enveloped by a flow. It goes without saying that the coefficient of pressure loss also rises with a greater ratio h/H.

By contrast with FIG. 2, in FIG. 3 the sharp connecting edge 16 is that point at which the channel flow is first applied. The element is rotated by 180°. As is to be seen from the representation, the two contra-rotating vortices have changed their sense of rotation. They rotate above and along the roof surface and tend towards the wall on which the vortex generator is mounted.

A number of vortex generators 9 are juxtaposed on the housing wall 21 in the circumferential direction with or without interspaces. The height h of the elements 9 is approximately 90% of the channel height H. It is. also possible to arrange such vortex generators uniformly or in an axially stepped fashion in a plurality of planes of the housing.

Of course, the invention is not restricted to the exemplary embodiment shown and described. By distinction with pure water as extinguishing means, a mixture of water and foam would also be conceivable. It is also possible to use nitrogen or air as inert gas in addition to $CO_2$. Again, larger variations are possible in the case of the values specified for the extinguishing means and inert gas. Basically, it is true that the higher the water pressure and the lower the water temperature, the more $CO_2$ can be dissolved. It goes without saying that it is also possible to use other vortex-generating elements than the vortex generators shown; in principle, all static mixers are suitable to the extent that their pressure loss is not excessively high.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A device for introducing $CO_2$ into an extinguishing medium, comprising:

a housing having an upper end, a lower end, a longitudinal axis, and including a flow channel, a feed line for extinguishing means, a $CO_2$ feed pipe having an end, a metering valve for $CO_2$ in fluid communication with the feed pipe, and an outlet line;

wherein the housing is aligned with its longitudinal axis vertical, the feed line is connected to the housing at the housing lower end, and the outlet line branches off from the housing upper end;

wherein the $CO_2$ feed pipe extends into the housing from the housing upper end, extends at least approximately up to the housing lower end, and is provided at the feed pipe end with injection means;

wherein when $CO_2$ is in the feed pipe and is directed in a flow direction opposite to a flow direction of the extinguishing means, and the length of the feed pipe between the metering valve and injection means is selected such that during operation with the metering valve closed a gas cushion forms downstream of the metering valve.

2. The device in accordance with claim 1, wherein the $CO_2$ feed pipe includes first and second parts, the first part adjoining the metering valve and being formed of a material of poor thermal conductivity, and the second part adjoining the injection means and being formed of a material of good thermal conductivity.

3. The device in accordance with claim 1, further comprising vortex-generating means provided on the inner wall of the housing.

4. The device in accordance with claim 3, wherein the vortex-generating means comprises a plurality of vortex generators arranged next to one another over the width or the circumference of the housing wall transverse to the flow direction; and wherein at least one of said vortex generators has three free flow-enveloped surfaces which extend in the flow direction, one of which surfaces forms a roof surface and the two other form lateral surfaces;

wherein the lateral surfaces are flush with the inner wall and enclose an arrow angle with one another;

wherein the roof surface bears against the inner wall with an edge running transverse to the inner wall; and wherein the roof surface includes longitudinally directed edges, and the lateral surfaces include longitudinally directed edges which project into the flow channel, the roof surface longitudinally directed edges being flush with the lateral surfaces longitudinally directed edges and run at an angle of incidence (β) to the inner wall.

5. The device in accordance with claim 4, wherein the ratio of the height (h) of a vortex generator to the height (H) of the flow channel is selected such that directly downstream of the vortex generator the vortex generated fills up the entire partial channel height or the entire height of the channel part assigned to the vortex generator.

6. A method for operating the device as claimed in claim 1, which comprises the following steps:

closing the metering valve, wherein the extinguishing means penetrates through the injection means into the feed tube, compresses the gas column present therein and displaces it against the metering valve by forming a gas cushion; and opening the metering valve, wherein liquid $CO_2$ penetrates into the feed pipe and displaces the column of extinguishing means back into the housing, $CO_2$ being heated and at least partially vaporized upon reaching the triple point, and more $CO_2$ is introduced into the extinguishing means through the injection means than can be dissolved therein to form a bubble flow.

7. The device in accordance with claim 1, further comprising vortex-generating means provided on the outer wall of the $CO_2$ feed pipe.

* * * * *